US005950916A

United States Patent [19]

Santangelo

[11] Patent Number: 5,950,916

[45] Date of Patent: Sep. 14, 1999

[54] SECURITY ENVELOPE

[76] Inventor: Pasquale J. Santangelo, 5 Country Squire Rd., Saddle River, N.J. 07458

[21] Appl. No.: 08/818,950

[22] Filed: Mar. 17, 1997

[51] Int. Cl.[6] ..... B65D 27/06

[52] U.S. Cl. ..... 229/301

[58] Field of Search ..... 229/300, 301, 229/303, 305, 306

[56] References Cited

U.S. PATENT DOCUMENTS

| | | | |
|---|---|---|---|
| 192,522 | 6/1877 | Marshall | 229/301 |
| 380,616 | 4/1888 | Bobrick . | |
| 661,690 | 11/1900 | Forney | 229/301 |
| 679,558 | 7/1901 | Gays | 229/301 |
| 680,480 | 8/1901 | Ernst | 229/305 |
| 1,354,092 | 9/1920 | Crate . | |
| 1,568,880 | 1/1926 | Conklin . | |
| 3,270,948 | 9/1966 | Donovan | 229/303 |
| 3,856,198 | 12/1974 | Daley | 229/303 |
| 3,894,755 | 7/1975 | Cieslak et al. | 283/1 |
| 4,715,531 | 12/1987 | Stewart et al. | 229/306 |
| 5,025,980 | 6/1991 | Blackman | 229/73 |
| 5,052,613 | 10/1991 | Lin | 229/303 |
| 5,400,957 | 3/1995 | Stude | 229/303 |
| 5,415,341 | 5/1995 | Diamond | 229/80 |

FOREIGN PATENT DOCUMENTS

| | | | |
|---|---|---|---|
| 127423 | 6/1919 | United Kingdom | 229/303 |
| WO 93/19991 | 10/1993 | WIPO | 229/300 |

*Primary Examiner*—Stephen P. Garbe
*Attorney, Agent, or Firm*—Thomas L. Adams

[57] ABSTRACT

A security envelope has a body with an interior space. A flap attached to the body can close the interior space. This flap has a plurality of sequential panels. The envelope is adapted to allow each of the panels to successively fasten to the body. The panels are also adapted to be successively removed from the flap to open the envelope. Thus the envelope can be repeatedly closed and opened. The envelope can be used by fastening a first one of the panels to the envelope body to close the envelope. The envelope can then be opened by separating this first panel from the flap. The envelope can then be closed by fastening a second one of the panels to the envelope body. The envelope can then be reopened by separating this second panel from the flap.

18 Claims, 2 Drawing Sheets

SECURITY ENVELOPE

BACKGROUND OF THE INVENTION

1. Field of the Invention

The present invention relates to a security envelope, and in particular, to a envelope that can be used to circulate documents between multiple locations while providing a means for securing the contents. Envelopes of this type can be used to transport confidential or other documents or articles between different locations while permitting the resealing and forwarding of the envelope after the contents have been examined.

2. Description of Related Art

There is a need to have an envelope that can be used to provide security of certain documents and still permit the sequential review and, perhaps, signing or initialing of said documents. Therefore, there exists a need for a envelope that can easily be resealed and provide circulation of documents to various personnel while maintaining the security of the contents.

In U.S. Pat. No. 5,025,980 an envelope is shown with a pair of differently sized, separate sealing flaps. The larger one may be sealed onto a removable address card. Upon receipt, the larger flap is removed along with the removable address panel. Thereafter, the smaller flap is exposed and may be used to reseal the envelope for a second mailing. This reference is relatively complex and still does not leave a simple record of successive addressees.

U.S. Pat. No. 5,400,957 shows a reusable envelope. When first opened, a second larger flap can be pulled from inside the envelope and used to reseal the envelope for a second mailing. This reference is again complex and fails to provide a simple record of successive addressees.

U.S. Pat. No. 5,415,341 shows a variety of envelopes that have selectable and removable flaps that can change the standard addressee or addresser. Other options are given to expose or cover a business reply mail legend. This reference is not designed for successive mailings to different addressees.

U.S. Pat. No. 1,568,880 shows an envelope with removable sections that can be used to facilitate registered mail. This envelope is not designed to be reusable. See also U.S. Pat. No. 380,616.

U.S. Pat. No. 1,354,092 shows an envelope designed for routing to successive addressees. The names of the successive addressees are placed in transparent pockets. As the envelope is routed the succession is indicated by moving a snap to the next addressee. The envelope, however, lacks a means for controlling access and making a verifiable record of the recipients.

See also U.S. Pat. Nos. 679,558 and 3,894,755.

Accordingly, there is a need for an improved security envelope that can be used to route documents to a succession of addressees while leaving a record of the recipients.

SUMMARY OF THE INVENTION

In accordance with the illustrative embodiments demonstrating features and advantages of the present invention, there is provided a security envelope with a body having an interior space. The envelope includes a flap attached to the body for closing the interior space. This flap has a plurality of sequential panels. The envelope is adapted to allow each of the panels to successively fasten to the body. The panels are also adapted to be successively removed from the flap to open the envelope. Thus, the envelope can be repeatedly closed and opened.

A security method in accordance with another aspect of the invention, employs an envelope having an envelope body and a flap. The method includes the steps of fastening a first portion of the flap to the envelope body to close the envelope. Another step is separating the first portion from the flap to open the envelope. The method also includes the step of fastening a second portion of the flap to the envelope body to close the envelope. Another step is separating the second portion from the flap to open the envelope.

By employing the foregoing envelope or method, one can securely circulate sensitive documents in a single envelope that leaves a record of the recipients. In a preferred embodiment, the security envelope can be circulated to multiple addressees and be re sealed after each delivery. This may be accomplished by using an envelope that has a closure flap that is divided into removable panels or sections separated by perforations or tear strips. This removability allows the envelope to be opened, the contents reviewed and then resealed and forwarded to the next recipient.

The removable panels or sections each have location for identifying the successive addressees in the order of circulation, ending with an identification of the original sender. This allows the contents of the envelope to be returned to its original sender.

In a preferred embodiment, the separable panels do not occupy all the area of the flap, in order to leave a buffer between the last panel and the hinge line. This allows a user to tear open the envelope at the hinge line without damaging the last panel. Accordingly, any addressing information placed on the last panel will not be defaced.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
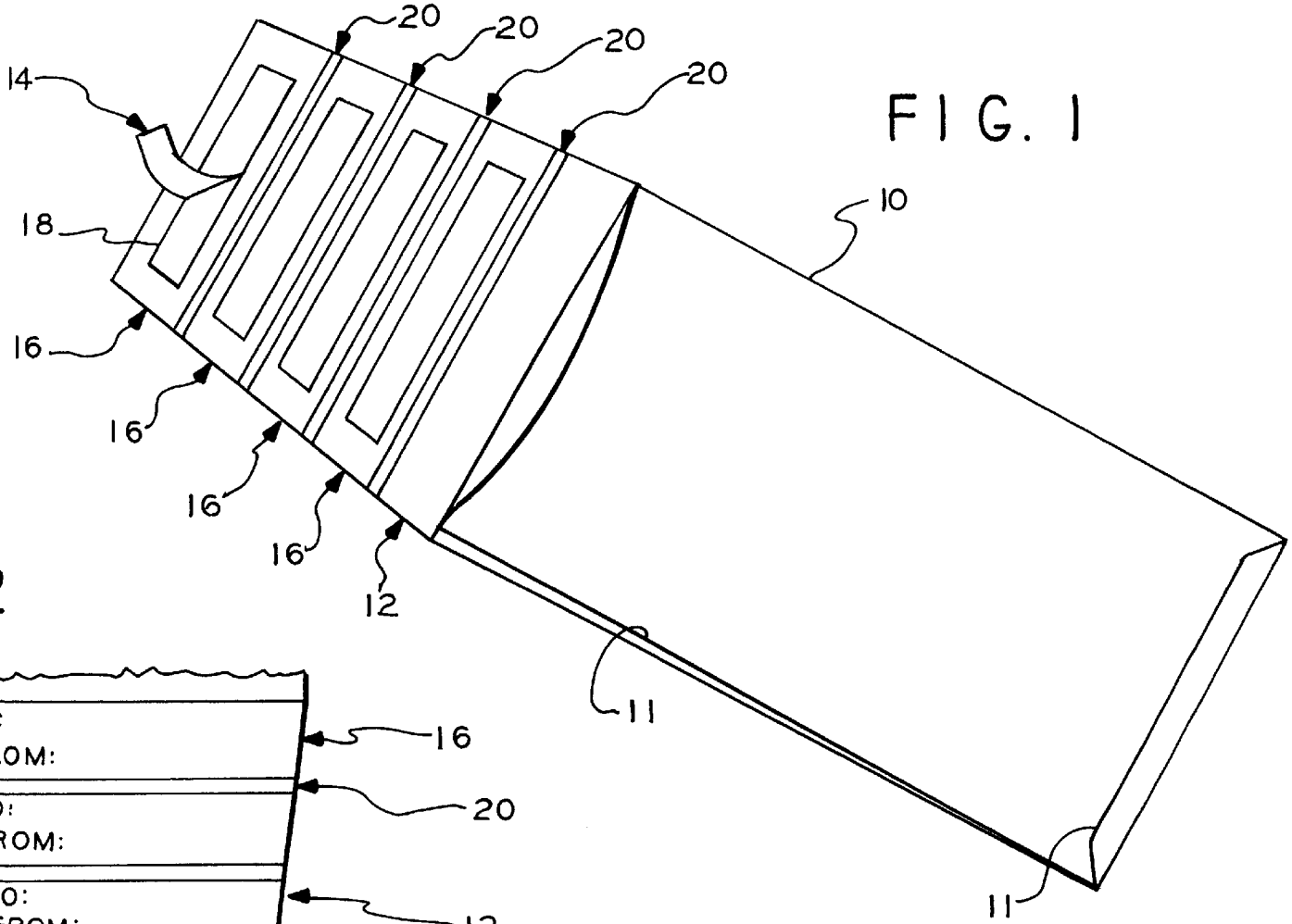
FIG. 1 is an plan view of the security envelope, showing the underside of the flap.

Referring to FIG. 1, to the preferred envelope is displayed in its open, unused position. The envelope is composed of two integral parts, both made preferably of a single sheet of heavy paper. The envelope body 10 is folded into two rectangular sheets to form an interior space capable of holding documents. In alternative embodiments the overall shape, thickness, length and width of the envelope can be altered to accommodate specific sized documents or other articles. The seams 11 of envelope body 10 are glued or otherwise fastened together to hold its shape and seal the side and bottom of envelope body 10.

An end section 12 forms a flap hinged to the body 10 of the envelope to provide a means of closure. In the preferred embodiment, flap 12 is divided into four sequential panels (or portions) 16, but this number can be varied as desired for specific applications. Each panel 16 has on its underside an adhesive strip 18 used for sealing the envelope. In some embodiments strips 18 may be a layer of adhesive that may be moistened before sealing. If the adhesive strip is a self-sealing, contact adhesive, it may be covered with a non-stick shield 14 to prevent unintentional sealing of the envelope.

Between the panels 16 are fault lines, shown herein as tear strips 20. The tear strips 20 are made by placing two parallel rows of perforations along opposite sides of strips 20. The tear strips 20 are shown parallel to the hinged joint of flap 12 and may be about ¼ inch (6.4 mm) wide, although other widths are contemplated as well. The tear strips 20 interleave with panels 16 and extend across the entire width of the flap. One of the ends of each of the perforated tear strips 20 is formed into a tab to facilitate removal. This permits the panels 16 to be easily separated without damaging the remainder of the flap.

Figure 2:
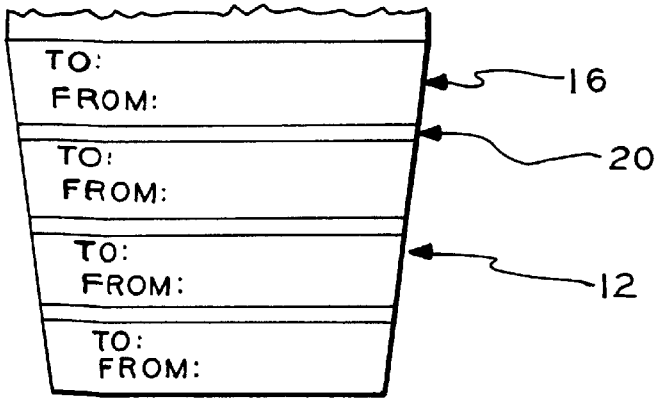
FIG. 2 is a fragmentary view of the outside of the flap of FIG. 1.
Figure 3:
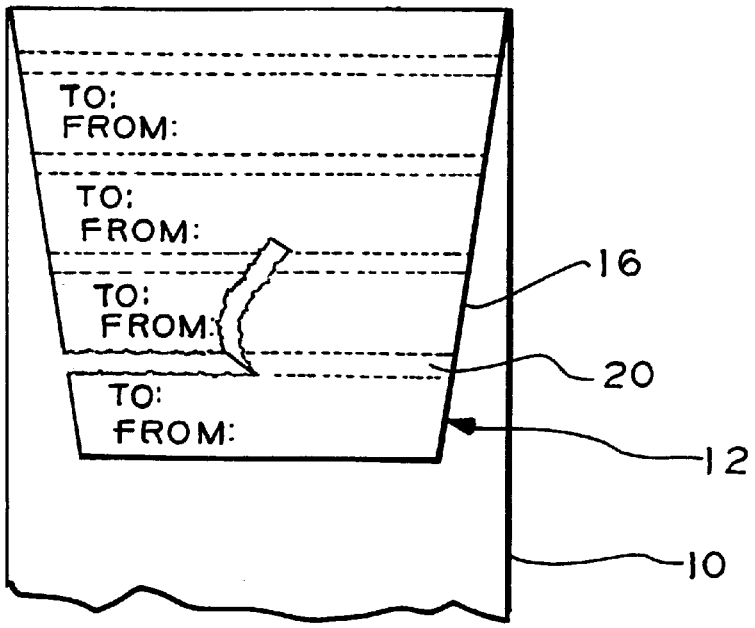
FIG. 3 is a detailed view of the envelope of FIG. 1 with the flap closed and in the process of being opened for the first time.
Figure 4:
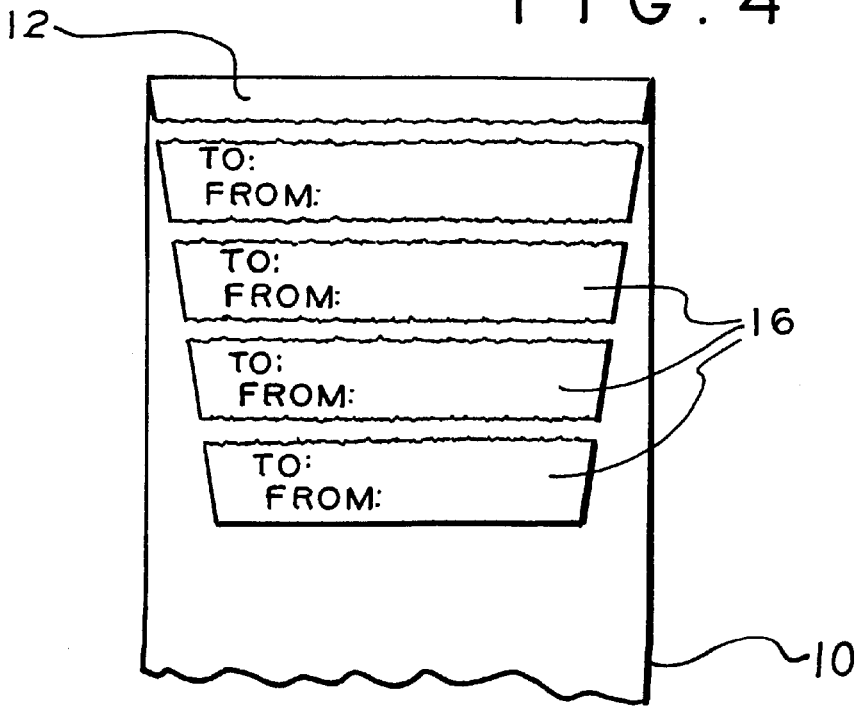
FIG. 4 is a detailed view of the envelope of FIG. 3 after final delivery.

Referring to FIGS. 2–4, the outside of flap 12 is printed with legends indicating the desired routing. Each panel 16 has a place for entering the name of the recipient and sender. In the illustrated, simplified form, the legends are "TO" and "FROM," although additional legends can be incorporated for further information, such as date, department, title, address, telephone number. Also in some embodiments, a signature line can be included to be used as a receipt to signed by each recipient. The tear strips 20 allow the envelope to be opened without the sender and recipient information being destroyed or removed from the envelope body.

Each panel 16 is approximately ½ inches high (3.8 cm) and the width of the flap will be about 9½ inches (24 cm), although those dimensions will vary depending on the desired overall size of the envelope and the flap. The height of the panels 16 will depend upon the amount of information to be entered on the front of the flap as well as the desired sealing strength In alternate embodiments, the envelope can be made in different sizes, materials and configurations to hold legal sized documents as well as larger, heavier documents. In addition, different thickness or materials can be used for transporting larger, heavier documents or non-documentary objects, such as articles of manufacture.

To facilitate an understanding of the principles associated with the foregoing apparatus, its operation will be briefly described. The disclosed envelope may be used to transfer sensitive or confidential correspondence, typically sent interoffice. Such correspondence is placed into the interior space in the body 10 of the envelope. The sender then fills out several of the panels 16 on the outside of the flap 12, one panel for each recipient. One additional panel may also filled out if the originator wishes to have the correspondence returned.

Thus the originator can fill in his/her own name adjacent the "FROM" legend of the first panel section 16 (the lowermost panel shown in FIG. 2) and the name of the first recipient adjacent the "TO" legend. After completing this first panel, the next panel 16 (second from bottom in FIG. 2) can be filled out be placing the name of the first recipient next to the "FROM" legend and the name of the second recipient next to the "TO" legend. The third recipient can be handled in a similar fashion by completing the third panel 16. If the originator wishes the document returned then the last panel 16 (with three recipient, the top panel in FIG. 2) is completed with the originator's name placed next to the "TO" legend and the last recipient's name next to the "FROM" legend.

Then the originator can, as shown in FIG. 1, expose the adhesive strip 18 on the first panel 16 section, by removing the non-stick shield 14. The envelope then is sealed by applying pressure to secure the flap 12 to the envelope body 12.

The envelope can then be delivered to the first recipient. Upon delivery the first recipient can tear out the tear strip 20 as shown in FIG. 3. (The first tear strip 20 is shown in its partially removed state.) Although this tear strip 20 is removed, the remaining panels 16 stay part of the flap 12. The first panel 16 (lowermost panel in FIG. 3) remains secured to the envelope body 10. Thus this first panel remains on the envelope body 10 as a permanent record.

The first recipient can initial this first panel and, after reviewing the enclosures, reseal the envelope by exposing the adhesive strip 18 on the second panel 16 (FIG. 1). In this manner the documents can be sent to successive recipients while maintaining security. When the originator receives the envelope back the last tear strip 20 is removed as is shown in FIG. 4. Therefore, a permanent record exists on the four panels 16 of whom received the correspondence.

As illustrated in FIG. 4, when the user opens the envelope 10 for the last time, the last one of the panels 16 will not be defaced by the opening process. Even if the user decides to open the envelope by tearing at the hinge line of the flap 12, the last panel will be separated from the hinge line by a buffer, which will protect the information on the last panel from being defaced.

It is appreciated that various modifications may be implemented with respect to the above described, preferred embodiment. In some embodiments, the flap may be resealed with adhesive tape, rivets or other fastening means. Also the flap may shorter than as illustrated, or be as long as the envelope body. Also the tear strips may be replaced with a single row of perforations or a tear string Alternatively, the separation of the panels may be effected solely by an independent tool such as a knife, scissor or the like. In some embodiments the envelope may be opened at several edges and closed by several independent flaps.

Obviously, many modifications and variations of the present invention are possible in light of the above teachings. It is therefore to be understood that within the scope of the appended claims, the invention may be practiced otherwise than as specifically described.

I claim:

1. A security envelope comprising:

a body having an interior space;

a flap attached to said body for closing said interior space, said flap having a plurality of sequentially separable panels, said panels being externally printed with legends calling for identification of an addressee, each of said panels having means (a) for separating said separable panels from said flap, and (b) for fastening successive ones of the panels to said body to remain there undefaced after separation from said flap to open said envelope, said flap being hingedly attached to said body along a hinge line, a last one of said separable panels and its legend being spaced from said hinge line, said flap being greater in area than all said separable panels together in order to leave a portion of said flap adjacent said hinge line to act as a buffer, said flap having only on said separable panels means for adhering to said body in order to avoid adhesion of the portion of said flap adjacent said hinge line, so that all of said separable panels can be sequentially separated from said flap, and adhered to said body, and so that said envelope can be repeatedly closed and opened.

2. A security envelope according to claim 1 wherein said panels include means for adhering to and remaining on said body before and after removal from said flap.

3. A security envelope according to claim 2 wherein said flap is hingedly attached to said body.

4. A security envelope according to claim 3 wherein said flap is folded against and integral with said body.

5. A security envelope according to claim 1 wherein said flap has a plurality of fault lines interleaved with said panels.

6. A security envelope according to claim 5 wherein each of said fault lines comprise a row of perforations.

7. A security envelope according to claim 5 wherein said flap is hingedly attached to said body along a hinge line that is parallel to said fault lines.

8. A security envelope according to claim 1 wherein said flap has a plurality of tear strips interleaved with said panels.

9. A security envelope according to claim 8 wherein each of said tear strips comprises:

a ribbon bordered by two rows of perforations.

10. A security envelope according to claim 1 comprising means for adhering said flap and said body together.

11. A security envelope according to claim 10 wherein said flap has at least one layer of adhesive.

12. A security envelope according to claim 11 wherein said flap has at least one shield removably overlying said layer of adhesive.

13. A security envelope according to claim 11 wherein said body has an opposing pair of rectangular sheets.

14. A security method for an envelope having an envelope body and a flap, comprising the steps of:

preparing an envelope by addressing said first and said second portion of said flap, and fastening a first portion of said flap to said envelope body to close said envelope;

separating said first portion from said flap to open said envelope while leaving said first portion fastened to said envelope body;

fastening a second portion of said flap to said envelope body to close said envelope; and separating said second portion from said flap to open said envelope while leaving said second portion fastened to said envelope body.

15. A security method according to claim 14 wherein the steps of separating said first and said second portions are performed by tearing.

16. A security method according to claim 14 wherein the steps of separating said first and said second portions are performed by tearing out a strip adjacent to them.

17. A security method according to claim 14 wherein the step of fastening the first and the second portions of the flap are performed adhesively.

18. A security method according to claim 14 wherein the step of fastening the first and the second portions of the flap are performed by gluing.

* * * * *